US011304461B2

(12) United States Patent
Martin et al.

(10) Patent No.: US 11,304,461 B2
(45) Date of Patent: Apr. 19, 2022

(54) UNITARY ARTICLE OF CLOTHING WITH OVERLAPPING WARMING JOINER BAND DEFINING A DOUBLE WAISTBAND

(71) Applicant: Tuxy Inc., Moncton (CA)

(72) Inventors: Derek Wayne Martin, Moncton (CA); Mario Albert Leblanc, Moncton (CA); Marcel Maurice Leblanc, Moncton (CA)

( * ) Notice: Subject to any disclaimer, the term of this patent is extended or adjusted under 35 U.S.C. 154(b) by 0 days.

(21) Appl. No.: 16/190,901

(22) Filed: Nov. 14, 2018

(65) Prior Publication Data

US 2019/0150533 A1 May 23, 2019

Related U.S. Application Data

(60) Provisional application No. 62/707,859, filed on Nov. 21, 2017.

(51) Int. Cl.
*A41D 13/02* (2006.01)
*A41D 15/00* (2006.01)

(52) U.S. Cl.
CPC ..... *A41D 13/02* (2013.01); *A41D 15/002* (2013.01); *A41D 2300/22* (2013.01); *A41D 2300/24* (2013.01)

(58) Field of Classification Search
CPC ..... A41D 13/02; A41D 2300/22; A41D 2300/24; A41D 15/002; A41D 1/02; A41B 11/146; A41B 13/005
USPC ..... 2/79, 76, 237, 269, 75, 80
See application file for complete search history.

(56) References Cited

U.S. PATENT DOCUMENTS 599,110 A * 2/1898 Prescott ..... A41D 13/02 2/79
997,669 A * 7/1911 Hall ..... A41D 13/02 2/79
1,137,659 A * 4/1915 Oilar ..... A41D 15/002 2/78.1
1,242,777 A * 10/1917 Danielson ..... A41D 13/02 2/79
1,255,334 A * 2/1918 Pease ..... A41D 13/02 2/79
1,281,473 A * 10/1918 Wright ..... A41D 15/00 2/70
1,293,280 A * 2/1919 Williams ..... A41D 13/02 2/79
1,430,409 A * 9/1922 Skelton ..... A41D 13/02 2/79

(Continued)

*Primary Examiner* — Alissa L Hoey
(74) *Attorney, Agent, or Firm* — The Roy Gross Law Firm, LLC; Roy Gross

(57) ABSTRACT

The present disclosure provides for a unitary article of clothing, typically referred to as a jumpsuit, comprising a jacket section and a pant section, one connected to the other by means of a joiner band. The joiner band is attached to both the jacket and pant sections and serves to provide additional warmth to a midsection of a user by providing at least three layers of fabric over the user's midsection. In addition to providing additional warmth, the joiner band also gives the jumpsuit the appearance of being a two-piece suit comprised of a sweater independent from the jogging pants. The jacket portion is also comprised of a closeable opening to allow a user to get into the pant section of the jumpsuit and subsequently also wear the jacket portion.

10 Claims, 8 Drawing Sheets

(56) References Cited

U.S. PATENT DOCUMENTS 1,461,798 A * 7/1923 Hildreth ..... A41D 13/02 2/79
1,611,420 A * 12/1926 Cuddy ..... A41D 13/02 2/79
1,837,654 A * 12/1931 Cohen ..... A41D 13/02 2/79
2,281,984 A * 5/1942 Martiny ..... A41D 13/02 2/79
2,390,462 A * 12/1945 Rosenberg ..... A41D 13/0005 2/70
2,507,463 A * 5/1950 Smith ..... A41D 1/21 2/76
2,580,024 A * 12/1951 Hoffman ..... A41B 13/04 2/70
2,971,199 A * 2/1961 Kozobarich ..... A41D 1/02 2/93
3,448,460 A * 6/1969 Frank ..... A41D 15/002 2/74
3,605,118 A * 9/1971 Elin ..... A41D 13/02 2/79
3,671,975 A * 6/1972 Vorsteher ..... A41D 1/082 2/232
3,711,865 A * 1/1973 Schifman ..... A41D 13/02 2/79
3,737,916 A 6/1973 Grenier
4,464,795 A * 8/1984 Long ..... B63C 11/04 2/2.17
4,573,218 A * 3/1986 Saggs ..... A41D 15/002 2/108
4,697,288 A * 10/1987 Palumbo ..... A41D 15/002 2/269
4,718,122 A * 1/1988 Steverson ..... A41D 15/02 2/70
4,890,337 A * 1/1990 Greenberg ..... A41D 1/06 2/220
4,976,653 A * 12/1990 White ..... A41D 1/21 450/155
5,138,717 A * 8/1992 Tolton ..... A41D 1/04 2/123
5,806,090 A * 9/1998 Johnson ..... B63C 11/04 2/2.15
6,058,508 A * 5/2000 Brown Honeysuckle ..... A41D 15/002 2/69
6,108,815 A * 8/2000 Majerfeld ..... A41D 3/06 2/247
6,279,161 B1 * 8/2001 Johnston ..... A41D 13/0015 2/69
6,389,600 B1 * 5/2002 Di Maio ..... A41B 9/06 2/115
7,305,717 B1 * 12/2007 Brown ..... A41D 13/1272 2/114
7,874,019 B2 1/2011 Woolcott et al.
7,966,669 B1 * 6/2011 Siepmann ..... A41D 15/002 2/123
8,402,562 B1 * 3/2013 Seddiki ..... A41D 27/205 2/247
8,819,865 B1 * 9/2014 Crye ..... A62B 17/001 2/2.14
2004/0006815 A1 * 1/2004 Carroll ..... A62B 17/006 2/457
2005/0022285 A1 * 2/2005 Berns ..... A41D 1/08 2/69
2005/0044605 A1 * 3/2005 Hofmann ..... A62B 17/001 2/69
2005/0144694 A1 * 7/2005 Aldridge ..... A41D 13/02 2/69
2005/0166300 A1 * 8/2005 Tanaka ..... A41D 1/04 2/108
2006/0064797 A1 * 3/2006 Pyeatt Rowe ..... A41D 13/12 2/244
2006/0107437 A1 * 5/2006 Griesbach ..... A41D 13/1209 2/114
2006/0191054 A1 * 8/2006 Noe ..... A62B 17/006 2/79
2006/0236442 A1 * 10/2006 Seguin ..... A41D 1/04 2/93
2007/0266472 A1 * 11/2007 DuFaux ..... A41B 13/005 2/80
2010/0175161 A1 * 7/2010 Jarboe ..... A41D 13/085 2/69
2016/0270728 A1 * 9/2016 McGinnis ..... A61B 5/0205
2018/0271193 A1 * 9/2018 Aitch ..... A41D 13/0015
2018/0352878 A1 * 12/2018 Smith ..... A41D 27/10
2019/0246723 A1 * 8/2019 Reimer ..... A41D 1/02
2020/0069251 A1 * 3/2020 McGinnis ..... A62B 17/006

* cited by examiner

UNITARY ARTICLE OF CLOTHING WITH OVERLAPPING WARMING JOINER BAND DEFINING A DOUBLE WAISTBAND

FIELD

The present disclosure pertains to sporting articles of clothing, and more particularly, to full-body jumpsuits having a warming joiner band and a double waistband.

BACKGROUND

Popular sport attire includes a hooded jacket, often referred to as a hoodie™ and jogging pants. People wear them for jogging, for attending football games, hockey games, for walking their dogs; for walking a nature trail, or for going to and returning from a gym or a sport practice. Although these hooded jackets and jogging pants are convenient and easy to wear, they have not benefited from improvement as seen in other sport garments.

One advantageous feature found in outdoor clothing is the provision of a flap between the jacket and the waistband of the pant, to prevent infiltration of cold air under the jacket. Examples of such overlapping flaps are illustrated and described in U.S. Pat. No. 3,737,916 issued to A. Grenier on Jun. 12, 1973, and U.S. Pat. No. 7,874,019 issued R. Woolcott et al., on Jan. 25, 2011. In both examples, these flaps are made of non-extensible, weather-resistant fabrics, joined to the jacket or to the pants by zippers. Such stiff fabrics and zippers around the waist area do not associate well with a hooded jacket and jogging pants.

Another advantageous feature found on modern exercising garments is the provision of a double waistband on the pants worn during exercises. Such double waistbands have the effects of a slimming belt. A double waistband is believed to aid in weight loss or at least give the appearance of weight loss. A double waistband is believed to act as a mini-sauna to warm one's belly and help to sweat off weight around one's mid-section. A double waistband improves posture, helps to boost self-confidence and inspire oneself to work harder to achieve maximum weight loss or toning goals. Although these advantages have been known, it is believed that double waistbands have not been incorporated into jogging pants. The reason for this finding is perhaps because jogging pants are designed to have a loose comfortable fitting, teaching away from a conscientious posture.

In view of these findings, it is believed that there remains a market demand in the field of sport clothing for an improved sport apparel incorporating the advantageous features mentioned above.

SUMMARY

In a first aspect, the present disclosure provides a unitary article of clothing comprising a jacket section having a closeable opening along a length of the jacket section, the jacket section to be worn substantially over an upper body of a person; a joiner band having an upper edge and a lower edge, the joiner band attached to the jacket section to provide an additional layer of warmth to a midsection of the person; and, a pant section attached to the joiner band to be worn generally over a lower body of the person, wherein the closeable opening allows the person to get into the unitary article of clothing.

This brief summary has been provided so that the nature of the invention may be understood quickly. A more complete understanding of the invention can be obtained by reference to the following detailed description of the preferred embodiment thereof in connection with the attached drawings.

DETAILED DESCRIPTION

The preferred embodiments of the jumpsuit according to the present invention is described herein below with reference to the attached drawings. The drawings presented herein are freehand sketches and photographs. These freehand sketches and photographs are presented for convenience to obtain a filing date as early as possible and at a minimum cost to the inventors. Therefore, it should be understood that the drawings and photographs should not be scaled. It should be understood that straight lines are not always drawn straight and circle are not always round. Parallel, isometric or perspective features are not always illustrated as such. These drawings and photographs are presented to persons skilled in the art having a will to understand.

Figure 1:
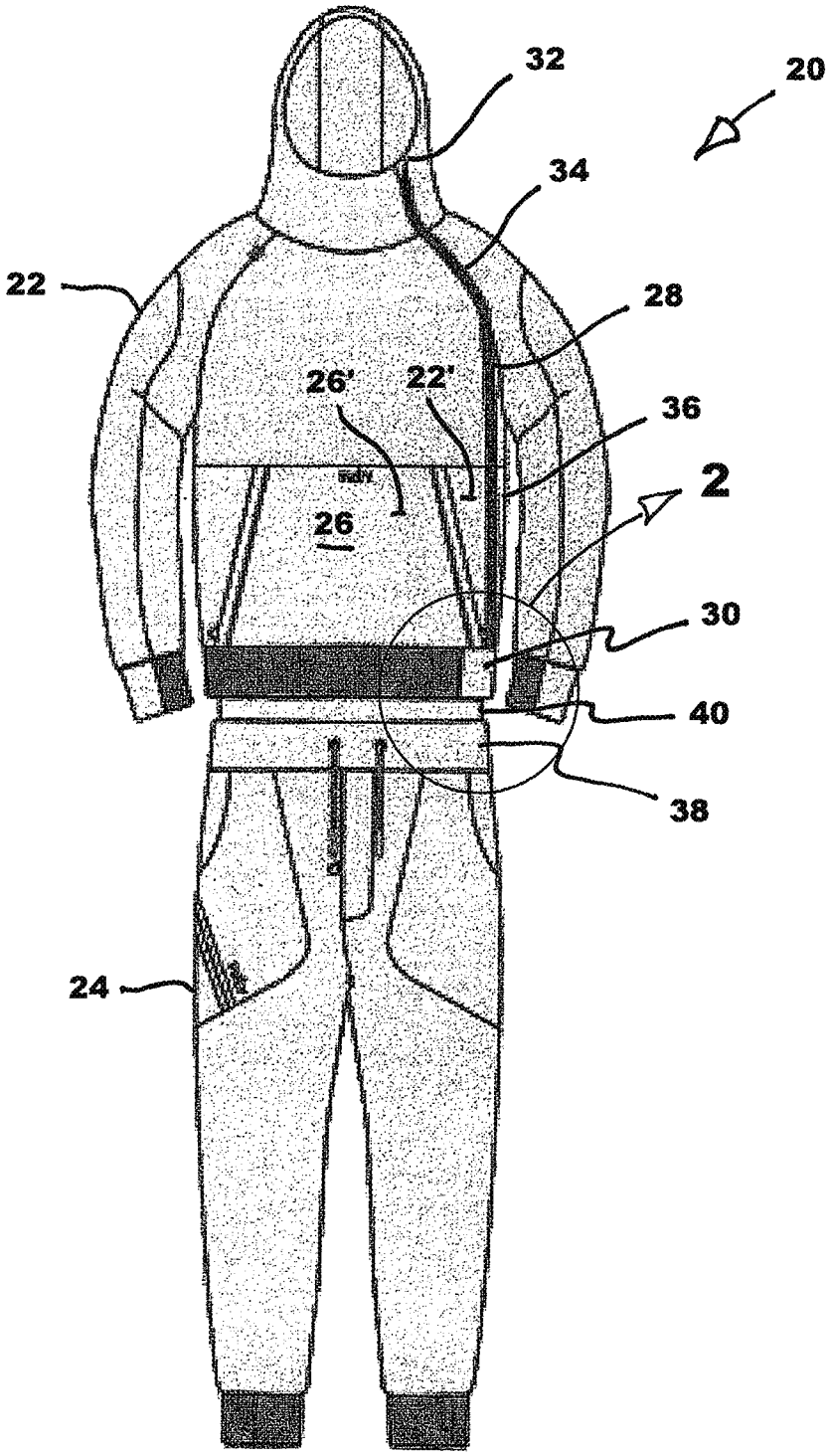
FIG. 1 is a front view of a jumpsuit according to the preferred embodiment of the present disclosure.

Referring to FIG. 1, the preferred unitary article of clothing, referred to herein as jumpsuit 20, is comprised of a hooded jacket 22 and jogging pants 24. The jacket 22 has a hand warming pouch 26 on the front thereof, and a zipper 28. The jacket 22 also has a jacket waistband 30. The jacket waistband 30 is seamless, as the zipper 28 stops short of this jacket waistband 30. The zipper 28 extends from the neck 32 of the hood, down along the raglan seam 34, and straight down along the underarm seam 36 of the jacket 22. The position of the zipper 28 provides a large opening in the front of the jacket 22, to facilitate the putting on or removing of the jumpsuit 20. The position of the zipper 28 is particularly appreciated by people with strong shoulders. The large opening at the upper-torso region of the jacket 22 makes it easy to insert one's arms and shoulders into the jumpsuit 20. The jogging pants 24 of the preferred jumpsuit 20 has a pants waistband 38. The pants waistband 38 is attached to the jacket waistband 30 by a warming joiner band 40, as can be seen in the detail circle 2 in FIG. 1 and in FIG. 2.

Figure 2:
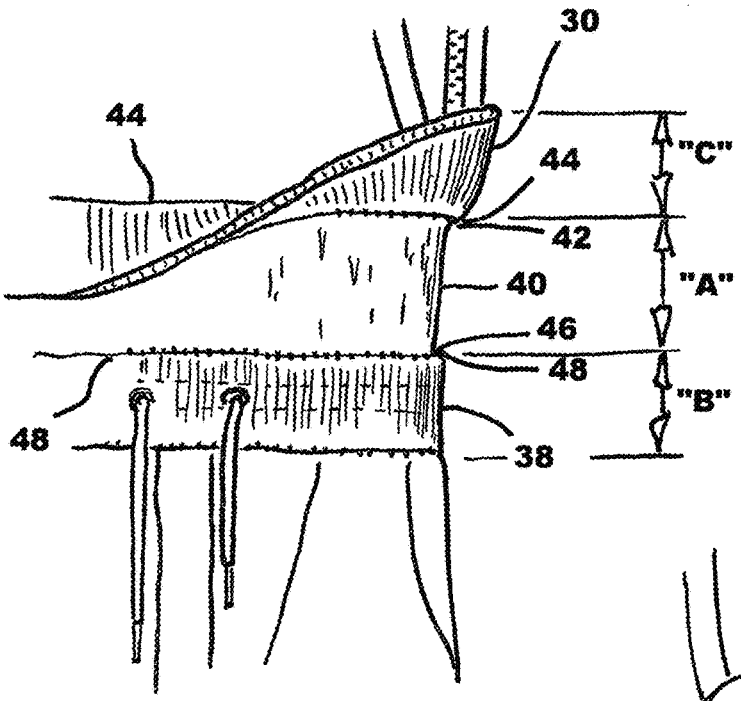
FIG. 2 is a partial enlarged view of the warming joiner band and waistband on the preferred jumpsuit as seen in detail circle 2 in FIG. 1, with the warming joiner band exposed.
Figure 3:
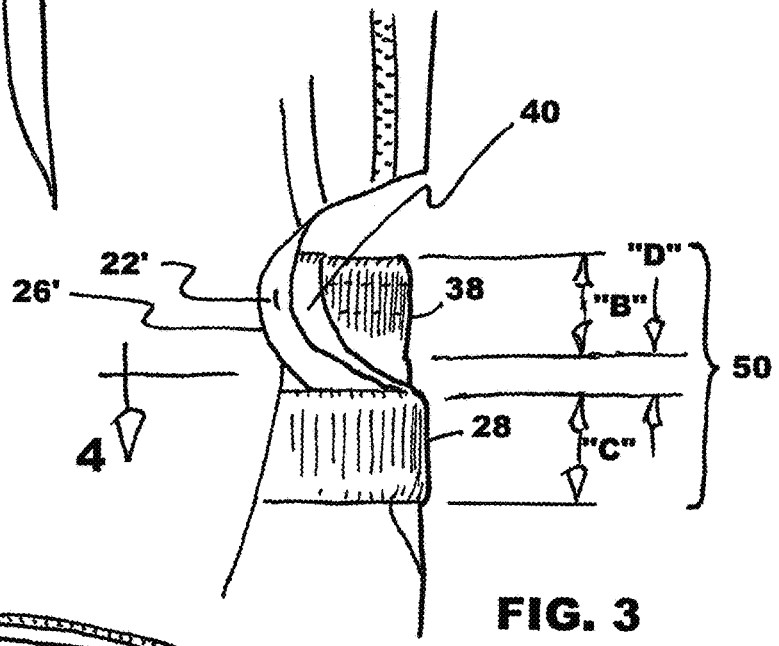
FIG. 3 is partial enlarged view of the warming joiner band and waistband on the preferred jumpsuit, with the warming joiner band defining a double waistband arrangement.
Figure 4:
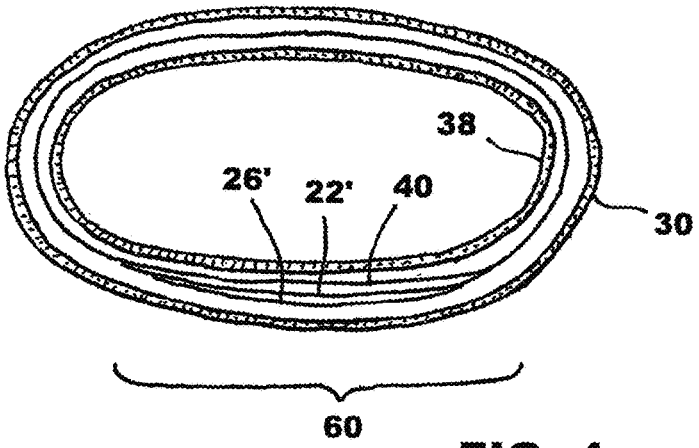
FIG. 4 is a partial, schematic, cross-section view of the double waistband as seen along line 4 in FIG. 3.

Referring now to FIG. 2, the jacket waistband 30 is illustrated in a folded up mode to expose the warming joiner band 40. The upper edge 42 of the warming joiner band 40 is sewn to the upper edge 44 of the jacket waistband 40. The lower edge 46 of the warming joiner band 40 is sewn to the upper edge 48 of the pants waistband 38. The width "A" of the warming joiner band 40 is slightly more that the width "B" of the pants waistband 38. When the warming joiner band 40 is folded over to overlap the pants waistband 38, the jacket waistband 30 lies below the pants waistband 38 as illustrated in FIG. 3. The width "A" of the warming joiner band 40 is also slightly more that the width "C" of the jacket waistband 30. When the warming joiner band 40 is folded over to overlap the pants waistband 38, a double waistband 50 is defined, as can be seen in FIG. 3. The distance "D" between the two waistbands 38, 30 is equivalent to the difference between dimensions "A" and "B". Because of the structure of the jumpsuit 30 according to the preferred embodiment, the abdominal region 60 of the jumpsuit 20 has several layers of fabric, as can be seen in FIGS. 3 and 4. The abdominal region 60 and more specifically, the front region of the double waistband 50 is made of several warming layers of fabric comprising; the pants waistband 38, the overlapping warming joiner band 40, the inside fabric layer 22' of the hand warming pouch 26, the outside layer 26' of the hand warming pouch 26, and the jacket waistband 30. The front portion 60, of the double waistband 50 has four layers of fabric to provide a warming region over the abdomen of the wearer, and all the benefits associated with such abdominal warming region. When the wearer of the jumpsuit 20 has his/her hands in the hand warming pouch 26, the abdominal warming experience is further enhanced.

Referring again to FIGS. 2, 3 and 4, the pants waistband 38 has a first degree of elasticity, that is common to pants waistbands. The jacket waistband 30 has a second degree of elasticity which is slightly less that the elasticity of the pants waistband 38. The pants waistband 38 and the jacket waistband 30 are made of ribbed expandable waistband materials. The warming joiner band 40 is made of single-layer expandable fleece-like material, for example. The warming joiner band 40 has a third degree of elasticity that is less that the first and second degrees of elasticity of the pants waistband 38 and the jacket waistband 30, respectively. Because of the attachment of the warming joiner band 40 to upper edges of both the jacket waistband 30 and the pants waistband 38, the warming joiner band 40 has a same circumferential length as the jacket waistband 30 and as the pants waistband 38. Therefore, when the warming joiner band 40 is folded over and overlapping the pants waistband 38 as illustrated in FIGS. 3 and 4, the warming joiner band 40 is stretched to a degree that is more than the pants waistband 38, to add to the tightness of the pants waistband 38. Normally, the pants waistband 38 has a drawstring therein for adjustment. In the preferred jumpsuit, the overlapping warming joiner band 40 is stretched evenly across its entire width. The stretched warming joiner band 40 provides a wide area of even fitness over the pants waistband 38. This area of even tightness or fitness is wider than that provided by a conventional drawstring. It will be appreciated that the stretched warming joiner band 40 eliminates concentrated pressure of a drawstring around the waist of the wearer. Similarly, when the jacket waistband 30 is brought over and overlaps both the warming joiner band 40 and the pants waistband 38, this jacket waistband 30 is stretched to a degree that is similar to the pants waistband 30, to provide a similar tightness as the pants waistband 30, and thus a double waistband effect.

Figure 5:
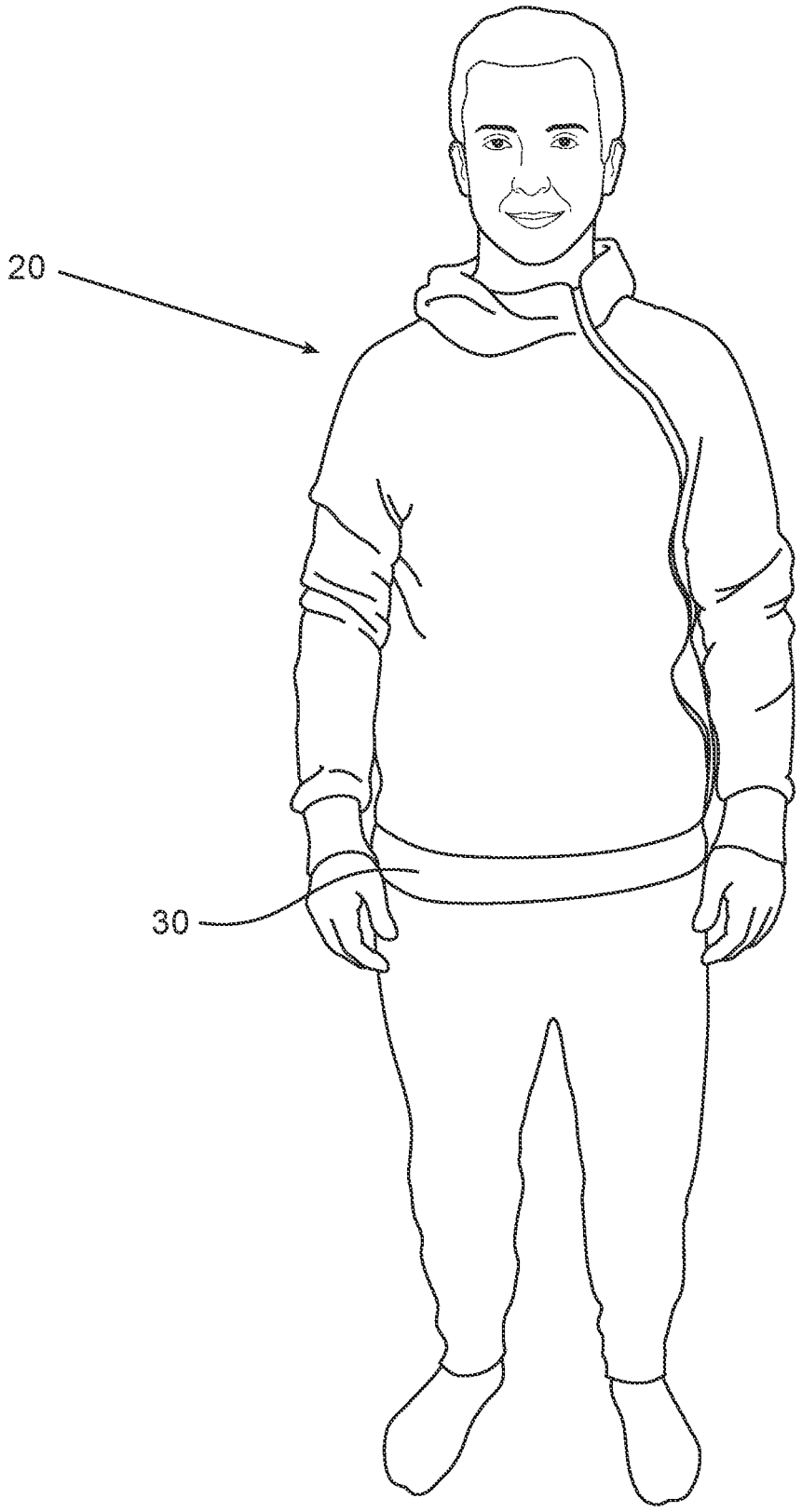
FIG. 5 is a front view of the preferred jumpsuit worn in a normal posture.

FIG. 5 illustrates the preferred jumpsuit 20 in a relaxed configuration, whereby the jacket waistband 30 is positioned below the pants waistband (not shown). In the relaxed configuration, the joiner band (not shown) is positioned over the pants waistband (not shown) such that there are at least three layers of fabric over a user's midsection, providing additional warmth.

Figure 6:
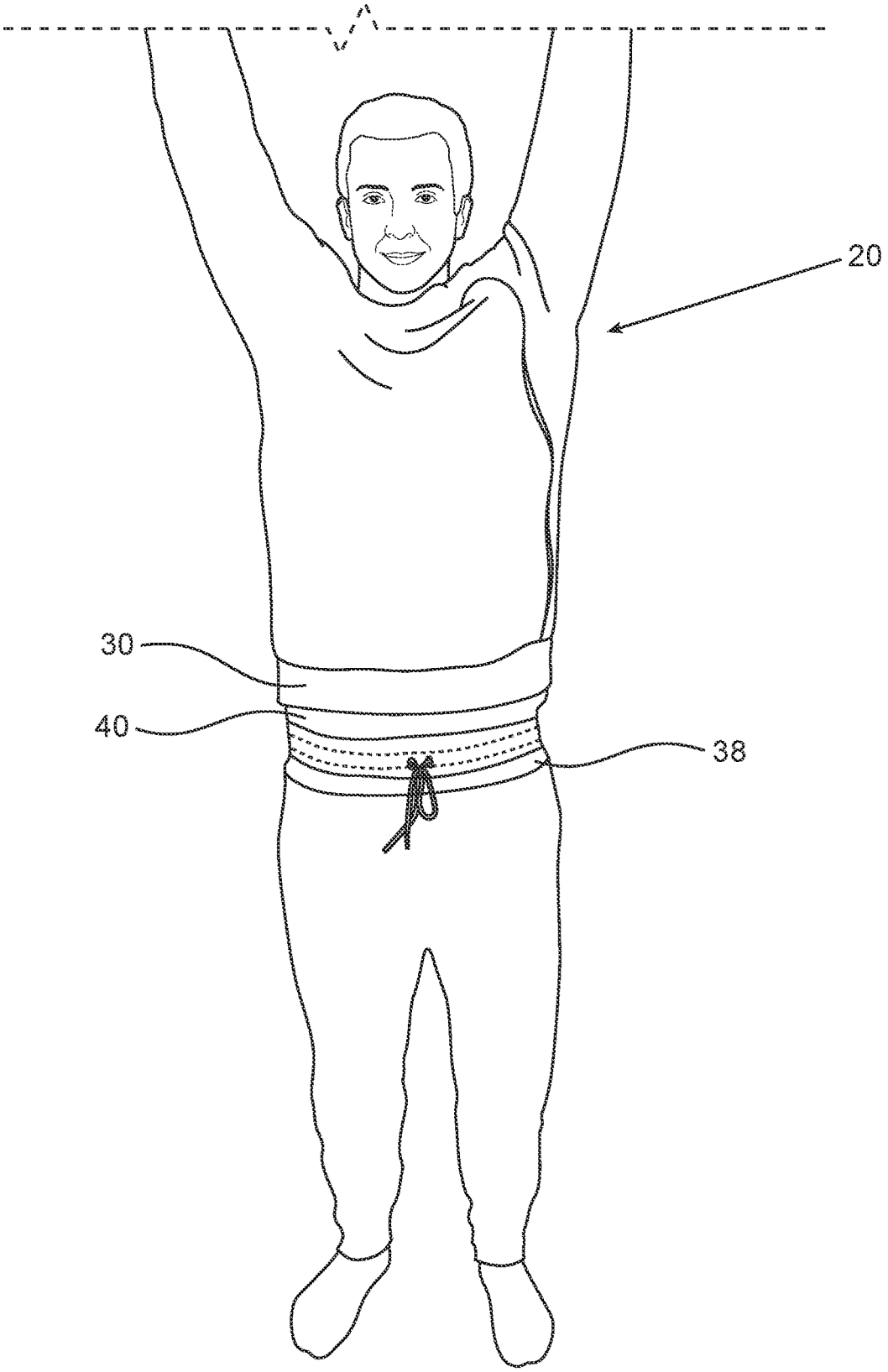
FIG. 6 is a front view of the preferred jumpsuit worn in an extended posture.

FIG. 6 illustrate the preferred jumpsuit 20 in an extended configuration, whereby the joiner band 40 is positioned in between the jacket waistband 30 and the pants waistband 38.

FIGS. 7, 8, 9 and 10 illustrate different details of the elements of the preferred jumpsuit 20. As can be appreciated, the preferred jumpsuit 20 is well fitted around the waist area of the wearer, to prevent infiltration of cold air therein, and to provide the wearer with a slim, athletic appearance. This sport jumpsuit 20 also has a unique look. This full body garment looks like a two-piece suit. The top garment drapes naturally over the bottom garment to give the impression that separate jacket and pants are worn. The jacket portion is free to move independently of the pants portion. Not only the preferred jumpsuit is more comfortable to wear than a conventional full-body suit, it avoids the bagginess around the hip area, usually associated with conventional onesies™ or conventional jumpsuits.

Figure 7:
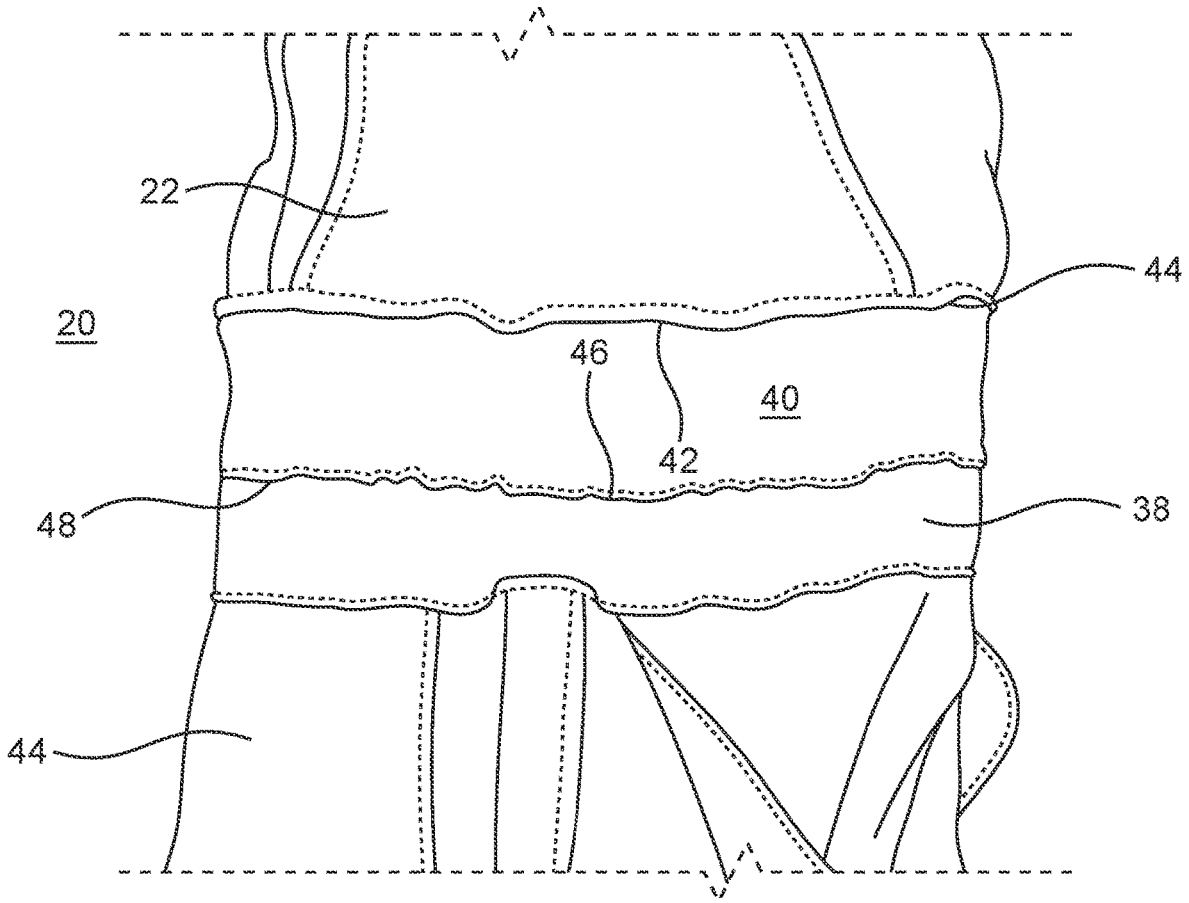
FIG. 7 is an inside-out view of the warming joiner band in the preferred jumpsuit.
Figure 8:
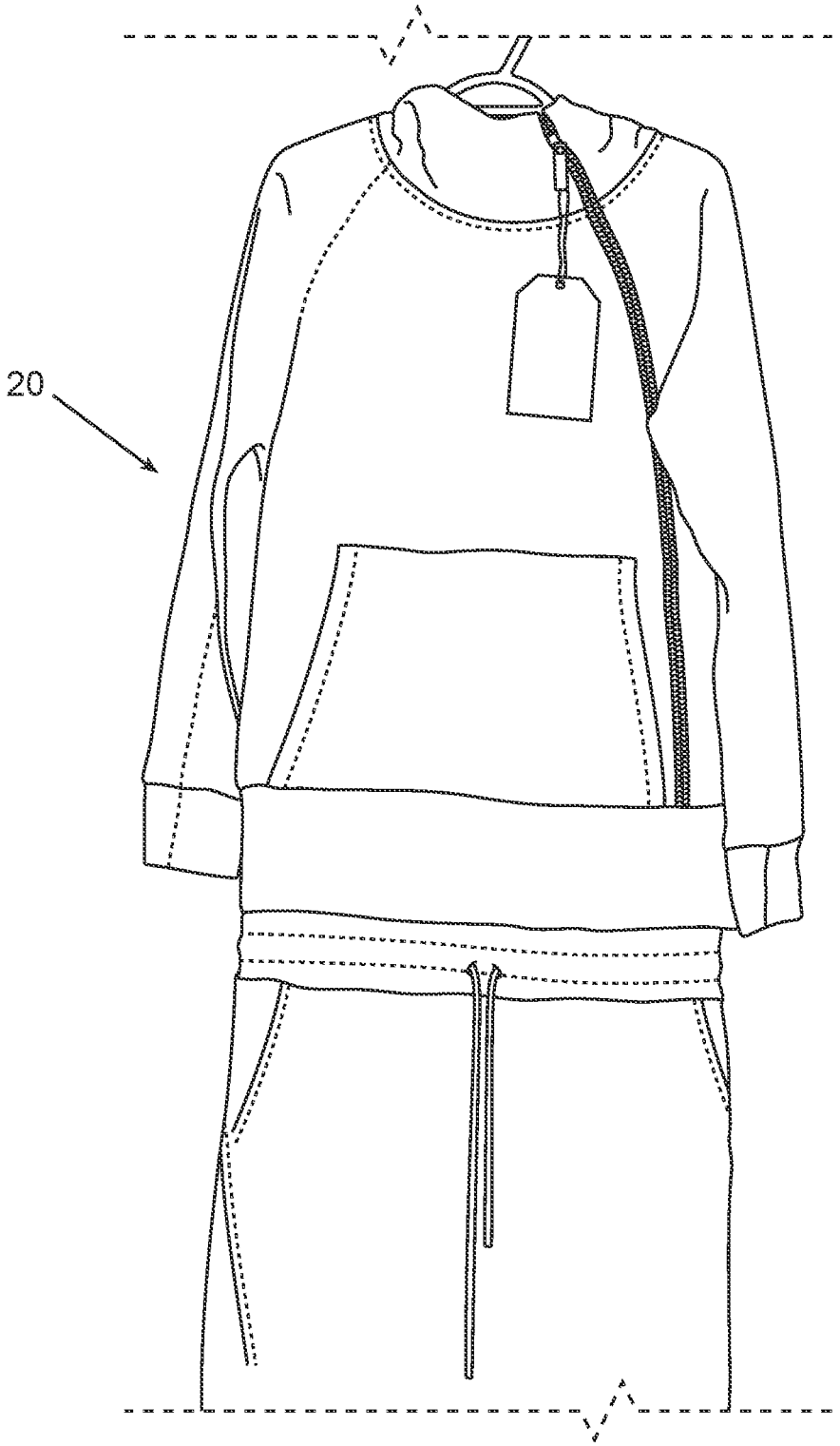
FIG. 8 is a front view of the preferred jumpsuit displayed on a hanger.
Figure 9:
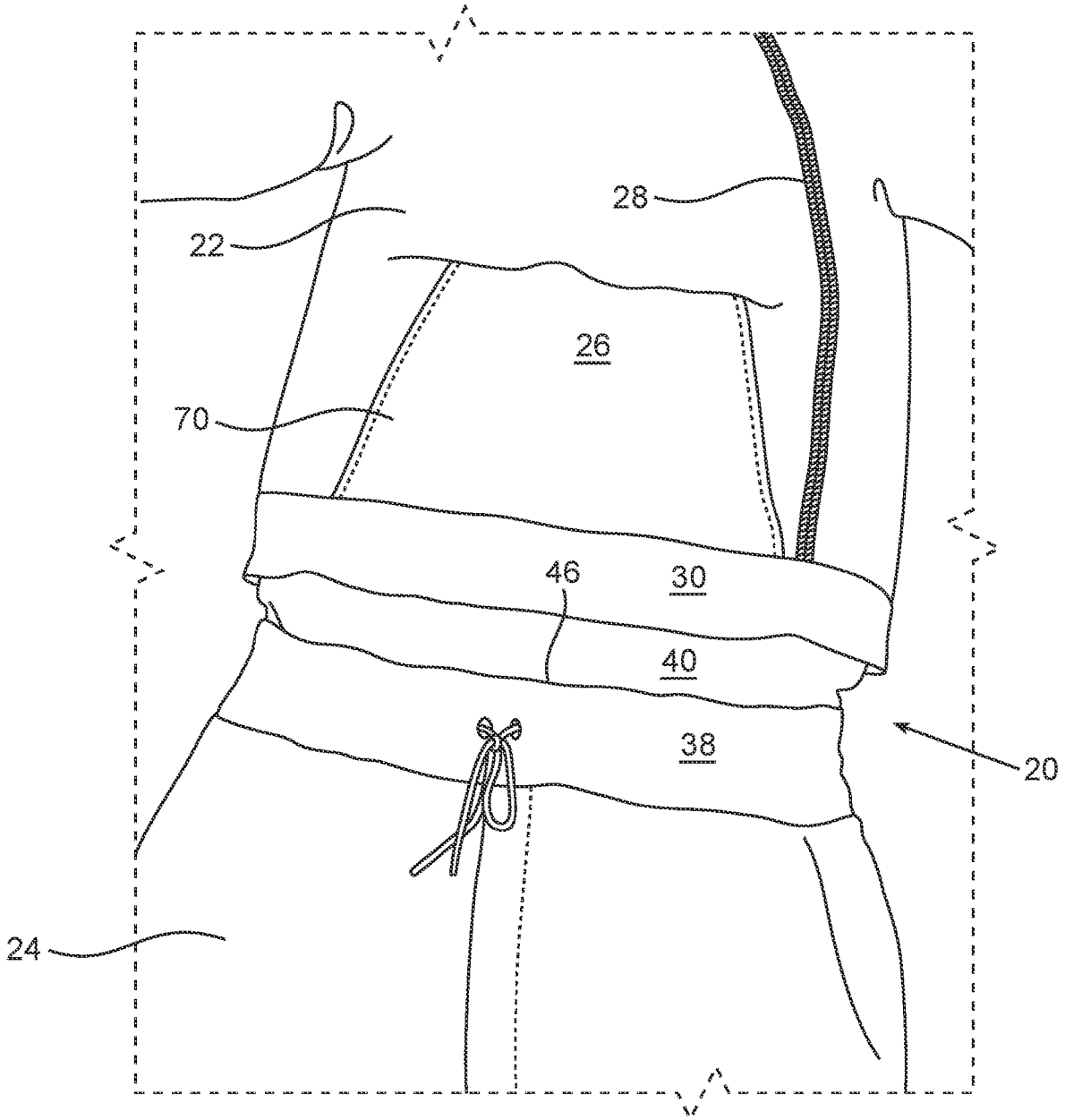
FIG. 9 is a front view of the preferred jumpsuit laid on a table in an extended mode; and, FIG. 10 is a front view of the preferred jumpsuit on a table in an extended mode, with the jacket waistband turned up to expose the warming joiner band.
Figure 10:
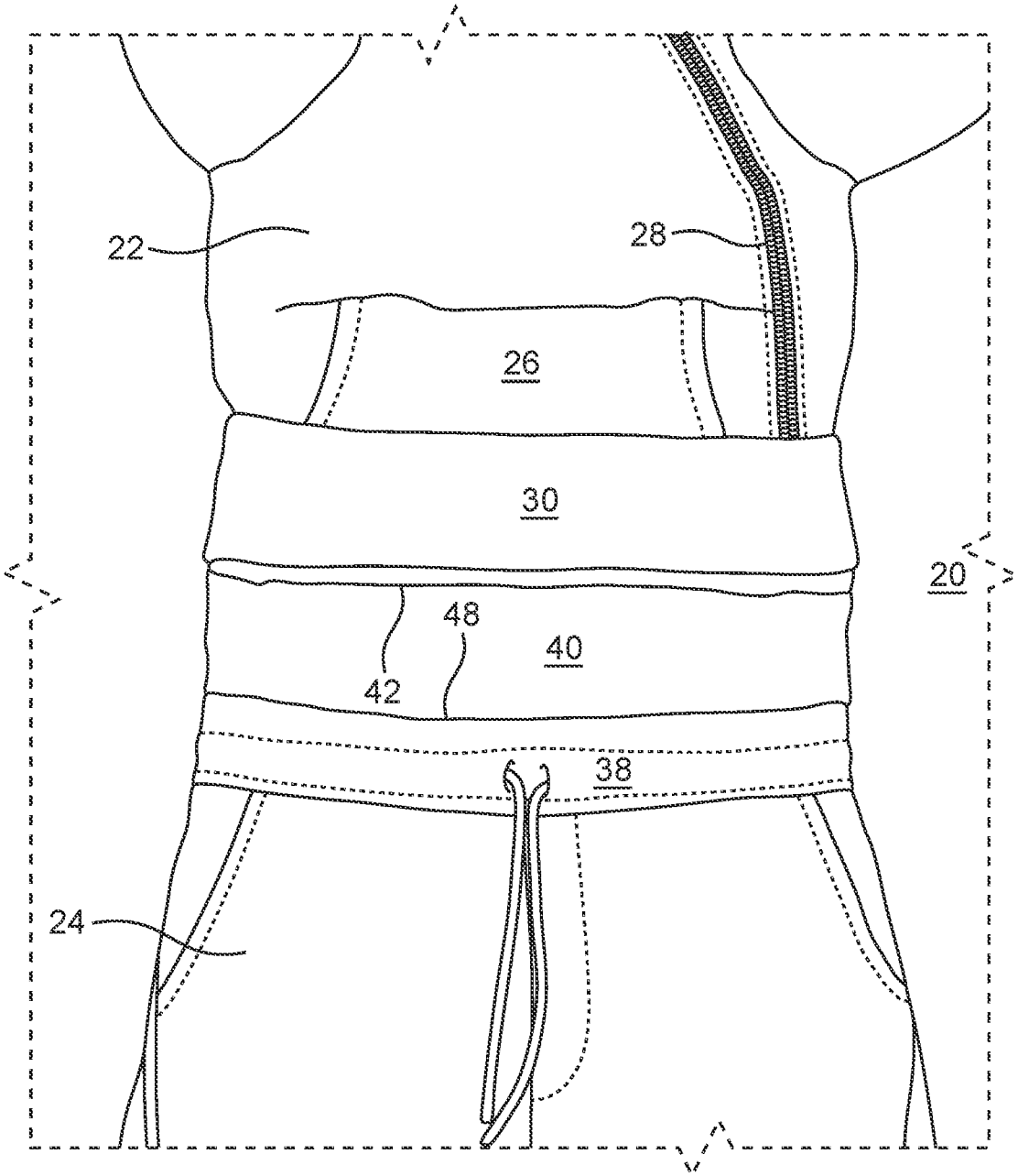

With specific reference to FIG. 7, the jumpsuit 20 is shown inside out, whereby the joiner band 40 is shown comprised of upper and lower edges 42, 46. The upper edge 42 of the joiner band 40 is attached to a top jacket edge 44 of the jacket waistband (not shown), while the lower edge 46 of the joiner band 40 is attached to a top pant edge 48 of the pant waistband 38.

With further reference to FIGS. 7, 8, 9 and 10, the unitary article of clothing 20 is shown comprising a jacket section 22 having a closeable opening 28, the closeable opening preferably a zipper but could also be buttons, Velcro™ or other suitable closeable means as known in the art. The closeable opening 28 is positioned along a length of the jacket section 22, which is worn substantially over one's upper body. A worker skilled in the art would understand that the jacket section 22 does not usually cover one's face or hands, such that it does not cover the entirety of the upper body. A joiner band 40 is also shown, the joiner band having an upper edge 42 and lower edge 46 and attached to both the jacket section 22 and the pant section 24 to provide additional layer of warmth to the midsection of a wearer. Indeed, a worker skilled in the art would appreciate that irrespective of a user stretching, the joiner band 40 is attached to the jacket and pant sections 22, 24 and therefore will never expose skin to ambient air. Indeed, the pant section 24 is attached to the joiner band 40 and the pant section 24 is worn generally and substantially over the lower body of a wearer. A worker skilled in the art would appreciate that the pant section 24 will typically not cover the feet of the wearer, although this is possible without departing from the scope of the disclosure. The jacket section 22 is further comprised of a jacket waistband 30, the jacket waistband 30 having a top jacket edge 44, while the pant section 24 is further comprised of a pants waistband 38, the pants waistband 38 further comprised of a top pant edge 48. The upper edge 42 of the joiner band 40 is attached to the top jacket edge 44 of the jacket waistband 30 while the lower edge 46 of the joiner band 40 is attached to the top pant edge 48 of the pant waistband 38. In the relaxed configuration, the joiner band 40 is positioned over the pant waistband 38 and a lower front portion 70 of the jacket section 22 is positioned over both the joiner band 40 and the pant waistband 38. Therefore, this relaxed configuration provides three layers of additional warmth to the midsection of the person: first, the lower front portion 70 of the jacket section 22; second, the joiner band 40; and third, the pant waistband 38. When the jacket section 22 is further comprised of a pouch 26, the pouch 26 provides a fourth layer of additional warmth as the pouch is comprised of an outer layer and an inner layer (not shown). The relaxed configuration also provides for a double waistband: the jacket waistband 30 positioned adjacent to and above the pant waistband 38.

The invention claimed is:

1. A unitary article of clothing comprising:

a jacket section having a jacket waistband and a closeable opening along a length of the jacket section, the jacket section configured to be worn substantially over an upper body of a person;

a joiner band having an upper edge and a lower edge, the joiner band attached to the jacket section; and, a pant section having a pant waistband, the pant section attached to the joiner band and configured to be worn generally over a lower body of the person, wherein the joiner band is moveable from a first position whereby the jacket waistband is extended over the joiner band, to a second position whereby a lower front portion of the jacket section is folded over the joiner band and the joiner band is folded over the pants waistband, the second position configured to provide three layers of additional warmth to the midsection of the person;

wherein the closeable opening is configured to allow the person to get into the unitary article of clothing while the jacket section is attached to the joiner band and the joiner band is attached to the pant section;

wherein the pant waistband has a first degree of elasticity, and the jacket waistband has a second degree of elasticity; and wherein the first degree of elasticity is greater than the second degree of elasticity.

2. The unitary article of clothing of claim 1, wherein the jacket waistband has an upper portion.

3. The unitary article of clothing of claim 2 wherein the pant waistband has a top pant edge.

4. The unitary article of clothing of claim 3 wherein the upper edge of the joiner band is attached to the upper portion of the jacket waistband and the lower edge of the joiner band is attached to the top pant edge of the pant waistband.

5. The unitary article of clothing of claim 4 wherein the jacket waistband is configured to fold upwardly and expose a circumference of the joiner band.

6. The unitary article of clothing of claim 1 wherein the jacket section is further comprised of a pouch positioned adjacent the jacket waistband, the pouch comprising an outer layer and an inner layer.

7. The unitary article of clothing of claim 6 wherein the joiner band is foldable over the pant waistband and the pouch of the jacket section is foldable over the joiner band and the pant waistband in the second position configured to provide four layers of additional warmth to the midsection of the person.

8. The unitary article of clothing of claim 1 wherein the closeable opening is one of: a zipper, hook and loop fasteners, and buttons.

9. The unitary article of clothing of claim 1 wherein the joiner band has a third degree of elasticity.

10. The unitary article of clothing of claim 9 wherein each one of the first and second degree of elasticity is greater than the third degree of elasticity.

* * * * *